US007091940B2

(12) United States Patent
Tsujimura et al.

(10) Patent No.: US 7,091,940 B2
(45) Date of Patent: Aug. 15, 2006

(54) ORGANIC LIGHT-EMITTING DIODE DISPLAY

(75) Inventors: Takatoshi Tsujimura, Fujisawa (JP); Kohichi Miwa, Yokohama (JP); Mitsuo Morooka, Kawasaki (JP)

(73) Assignee: Toppoly Optoelectronics Corp., Chu-Nan (TW)

( * ) Notice: Subject to any disclaimer, the term of this patent is extended or adjusted under 35 U.S.C. 154(b) by 265 days.

(21) Appl. No.: 10/392,616

(22) Filed: Mar. 20, 2003

(65) Prior Publication Data

US 2004/0001037 A1 Jan. 1, 2004

(30) Foreign Application Priority Data

Mar. 29, 2002 (JP) ..... 2002-097545

(51) Int. Cl.
*G09G 3/10* (2006.01)
*G09G 3/32* (2006.01)
*G09G 5/00* (2006.01)

(52) U.S. Cl. ..... 345/82; 315/169.3; 345/211; 345/212; 345/213

(58) Field of Classification Search ..... 345/55, 345/76–78, 82, 211–213; 315/169.3
See application file for complete search history.

(56) References Cited

U.S. PATENT DOCUMENTS 6,229,506 B1 * 5/2001 Dawson et al. ..... 345/82
6,229,508 B1 * 5/2001 Kane ..... 345/82
6,307,322 B1 * 10/2001 Dawson et al. ..... 315/169.1
6,611,107 B1 * 8/2003 Mikami et al. ..... 315/169.1
6,680,580 B1 * 1/2004 Sung ..... 315/169.3
6,731,276 B1 * 5/2004 Ishizuka ..... 345/211
6,738,034 B1 * 5/2004 Kaneko et al. ..... 345/76
6,753,654 B1 * 6/2004 Koyama ..... 315/169.1
6,858,989 B1 * 2/2005 Howard ..... 315/169.1
2002/0011796 A1 * 1/2002 Koyama ..... 315/169.1

OTHER PUBLICATIONS

Japanese Technology Evaluation Center Panel, Display Technologies in Japan, Jun. 1992, Loyola College in Maryland, Chapter 5: Amorphous Silicon: The Dominant Active Matrix Technology.*

* cited by examiner

*Primary Examiner*—Sumati Lefkowitz
*Assistant Examiner*—Alexander S. Beck
(74) *Attorney, Agent, or Firm*—Liu & Liu

(57) ABSTRACT

A technique to reduce the rate of increase in threshold voltage, i.e. degradation, of an amorphous silicon TFT driving an OLED. A first supply voltage is supplied to a drain of the TFT when a first control voltage is applied to a gate of the TFT to activate the TFT and drive the OLED. However, a second, lower supply voltage is supplied to the drain of the TFT when a second control voltage is applied to the gate of the TFT to deactivate the TFT and turn off the OLED, whereby a voltage differential between the drain and the source when the second control voltage is applied to the gate is substantially lower said first supply voltage. This reduces degradation of the TFT. According to one feature of the present invention, when the TFT is turned off by the absence of voltage applied to its gate, the voltage at the drain of the TFT is reduced to approximately zero to minimize the voltage differential between the drain and the source.

21 Claims, 5 Drawing Sheets

ORGANIC LIGHT-EMITTING DIODE DISPLAY

BACKGROUND OF THE INVENTION

The present invention relates generally to organic light-emitting diode (OLED) displays, and more specifically to TFT drivers for the OLEDs.

An OLED generates light by a current flowing through an organic compound which is fluorescent or phosphorescent and excited by electron-hole recombination. OLEDs have low profile and a wide view angle. There are two types of driving modes for the OLED, namely, a passive type and an active type. The active type is more suitable for a wide-screen and provides high-resolution. Thin-film transistors ("TFTs") are used to drive the active type of OLEDs. TFTs are made from two types of materials—poly silicon and amorphous silicon (a-Si).

A low temperature poly silicon TFT is capable of delivering a large current due to large mobility and is therefore capability of yielding a bright display. However, the poly silicon TFT requires nine photoengraving process (PEP) steps to manufacture, and therefore, is expensive to manufacture. Moreover, it is difficult to make a large screen with poly silicon TFTs, and today this is limited to about fifteen inches. On the contrary, the amorphous silicon ("a-Si") TFT can be formed with fewer manufacturing process steps, and therefore, is less expensive. Moreover, the a-Si TFT can be formed into a large screen and has high image quality with uniform luminance.

The OLED is a current-driven element and its luminance depends on the amount of current flowing through it. Accordingly, if the driving transistors do not supply a uniform current or if this current changes with time, the resultant image will degrade. The operation of the driving transistor is also impacted by the threshold voltage of its gate. The variation of the threshold voltage for poly silicon transistors initially and over time is small, which is advantageous. However, the variation of the threshold voltage for amorphous silicon over time is substantial, and this contributes to the lack of uniformity of the drive current. One reason for the variation of threshold voltage (Vth) for both types of TFTs is that electrons jump into a gate insulating film when the electrons flow on a channel of the TFT. Also, Si is charged by the electrons upon flowing on the channel of the TFT because the electrons disconnect Si bonds.

FIG. 6 is a graph showing variation of the threshold voltage (Vth) over time of an amorphous silicon TFT. The threshold voltage increase over time from about 0.7 V at the start to about 2.0 V after ten hours of operation. For a constant drive voltage, the output current decreases as the threshold voltage (Vth) increases resulting in lower luminence of the resultant image. Also, when Vth increases, the image gray-scale degrades near the black end.

An object of the present invention is to reduce the variation over time of a threshold voltage (Vth) of a TFT or other transistor used to drive an OLED.

SUMMARY OF THE INVENTION

The invention resides in a technique to reduce the rate of increase in threshold voltage, i.e. degradation, of an amorphous silicon TFT driving an OLED. A first supply voltage is supplied to a drain of the TFT when a first control voltage is applied to a gate of the TFT to activate the TFT and drive the OLED. However, a second, lower supply voltage is supplied to the drain of the TFT when a second control voltage is applied to the gate of the TFT to deactivate the TFT and turn off the OLED, whereby a voltage differential between the drain and the source when the second control voltage is applied to the gate is substantially lower said first supply voltage. This reduces degradation of the TFT. According to one feature of the present invention, when the TFT is turned off by the absence of voltage applied to its gate, the voltage at the drain of the TFT is reduced to approximately zero to minimize the voltage differential between the drain and the source.

DETAILED DESCRIPTION OF THE PREFERRED EMBODIMENTS

Figure 1:
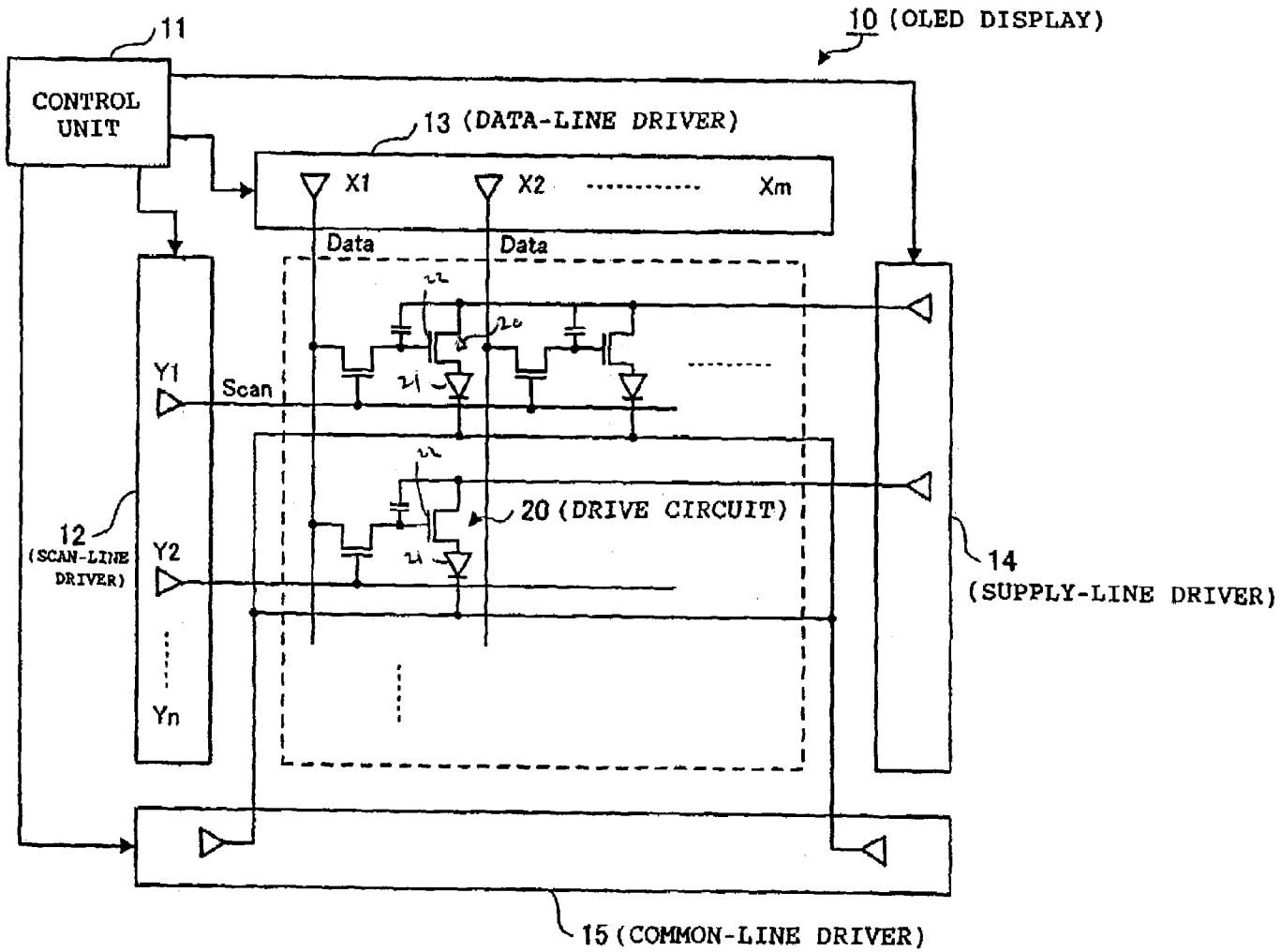
FIG. 1 is a circuit diagram of an active-matrix OLED display according to the present invention.

Referring now to the drawings in detail, wherein like reference numbers indicate like elements throughout, FIG. 1 shows an active-matrix OLED display 10 according to the present invention. Display 10 has m×n pixels each with an OLED 21 and TFT driver 22. OLED display 10 includes a control unit 11 for outputting a control signal for each drive circuit 20, 20 in required timing by processing supplied video signals. There is one drive circuit 20 for each pixel. A scan-line driver 12 supplies select signals (address signals) to scan lines Y1 to Yn based on the control signals from the control unit 11. A data-line driver 13 supplies data signals to data lines X1 to Xm based on the control signals from the control unit 11. A supply-line driver 14 is a two-level power source to supply either of two voltages to the drain of each TFT driver 22 and a current to the OLED via the TFT driver when the driver is activated. A common-line driver 15 returns the current supplied to the OLED. The common-line driver 15 is controlled by select signals from the scan-line driver 12 and by the data signals from the data-line driver 13. Display device 10 also includes a circuit structure (not shown) which generates the video signals to be supplied to the control unit 11. If desired, control unit 11 may be provided separately from the OLED panel. It is also possible to omit the common-line driver 15 so that the current supplied to the OLED is returned directly to ground.

Figure 2:
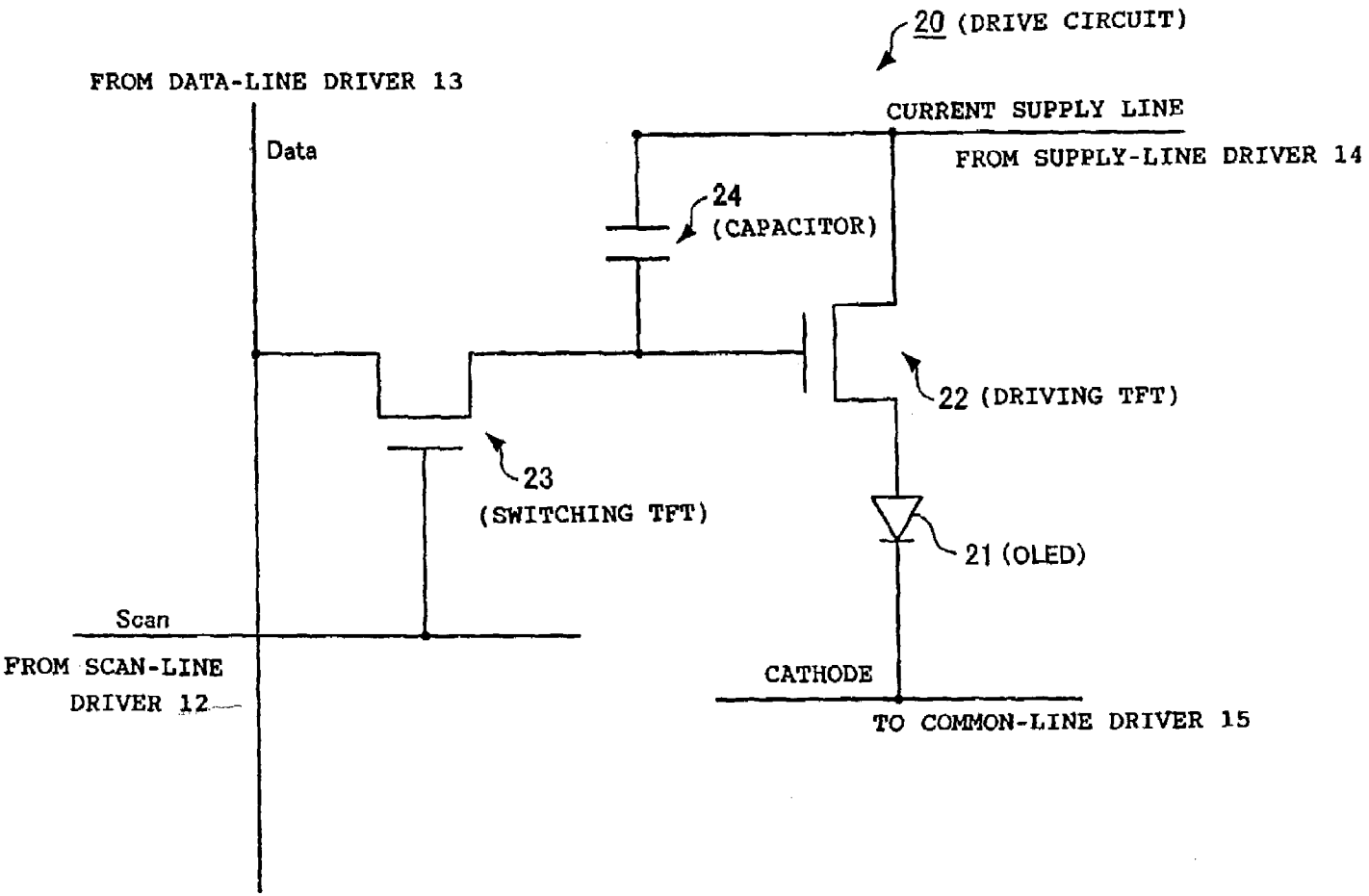
FIG. 2 is a circuit diagram of a drive circuit used in the OLED display of FIG. 1.

FIG. 2 shows the drive circuit 20 in more detail. Each drive circuit 20 includes an OLED 21 with an organic compound for a light-emitting layer, and an amorphous silicon TFT 22 for driving OLED 21. Another, switching TFT 23 operates drive TFT 22 based on the scan signal obtained from the scan-line driver 12 via a scan line and the data signal obtained from the data-line driver 13 through a data line. A capacitor 24 is connected to a current supply line of the supply-line driver 14 and stores electric charges to retain gate potential. In the present invention, the control unit 11 controls the supply-line driver 14 such that the gate voltage supplied to the driving TFT 22 and the supply-line voltage (referred to as a drain voltage in this embodiment) supplied to the drain of the driving TFT 22 rise intermittently and almost simultaneously. Note that the supply-line voltage will be connected to a source of an alternate driving TFT (in place of TFT 22) if the alternate TFT has an opposite channel orientation than that of TFT 22.

According to the present invention, the supply-line voltage (i.e. the drain voltage in the illustrated example) rises intermittently along with the gate voltage, to reduce the increase in a threshold voltage (Vth) of the driving TFT 22. For example, the supply-line voltage for driving TFT 22 rises from approximately zero volts to ten or fifteen volts when ten or fifteen volts is applied to the gate via switching TFT 23 to activate the TFT and substantial luminance is required from the driven OLED. The supply-line voltage will drop to approximately zero volts when approximately zero volts is applied to the gate of driving TFT 22 when no luminence is required from the coupled OLED. Typically, each OLED is stimulated intermittently, i.e. for less than 100% duty cycle.

Figure 3:
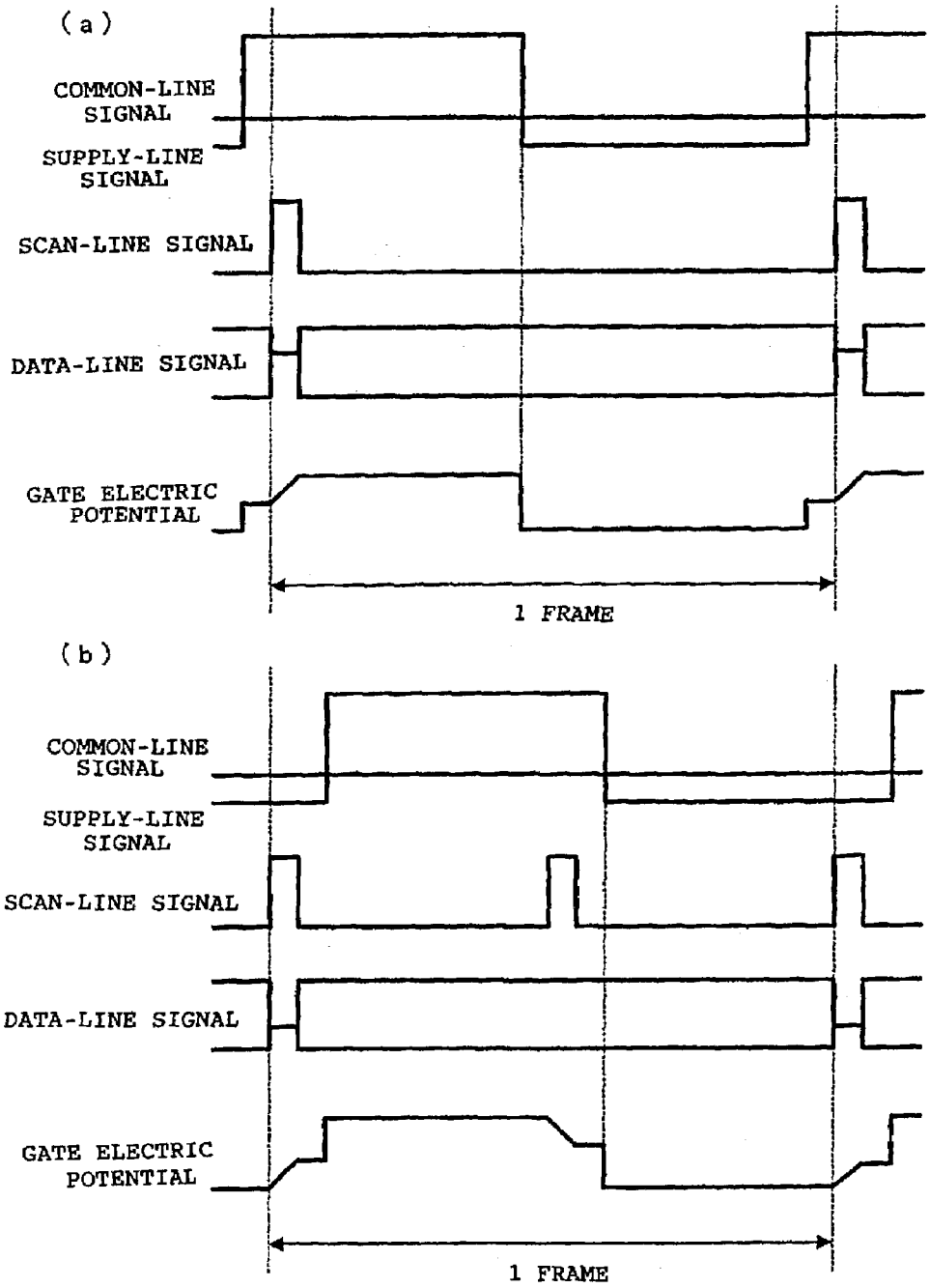
FIGS. 3(*a*) and (*b*) are timing diagrams of the drive circuit of FIG. 2.

FIGS. 3(*a*) and (*b*) are two timing diagrams of the drive circuit 20 controlled by the control unit 11 in two examples of the present invention. Each of the timing diagrams indicates a common-line signal obtained from the common-line driver 15, a supply-line signal obtained from the supply-line driver 14, a scan-line signal obtained from the scan-line driver 12, a data-line signal obtained from the data-line driver 13, and a gate voltage which appears at the gate of the driving TFT 22 of the drive circuit 20. The supply-line signal is operated with a duty ratio of 50%, for example. The supply-line signal switches on and off between pulses of the scan-line signal (in the case of FIG. 3(*a*)), or switches on and off sequentially in accordance with the respective pulses of the scan-line signal (in the case of FIG. 3(*b*)). The gate potential is dropped along with the drop of the supply-line signal. Specifically, the drops of the gate potential and the drain potential can be executed by dropping the supply-line signal from the supply-line driver 14.

In FIGS. 3(*a*) and 3(*b*), the gate potential of the driving TFT 22 and the supply-line signal rise intermittently and substantially simultaneously. This is because the current supply line from the supply-line driver 14 is connected to the gate electrode of the driving TFT 22 via capacitor 24. The voltage across capacitor 24 cannot change quickly. By way of example, the capacitor 24 is one picafarads. The supply-line driver 14 is provided between the current supply line and the drain of TFT 22. The present invention decreases the rise in Vth of TFT 22 over time by changing the drain voltage and gate voltage simultaneously or with some time interval between the changes in the drain voltage and gate voltage. The effective time interval between the change in the drain voltage and the change in the gate voltage can be tens of microseconds for both the increase in the drain and gate voltages and the decrease in the drain and gate voltages.

Figure 4:
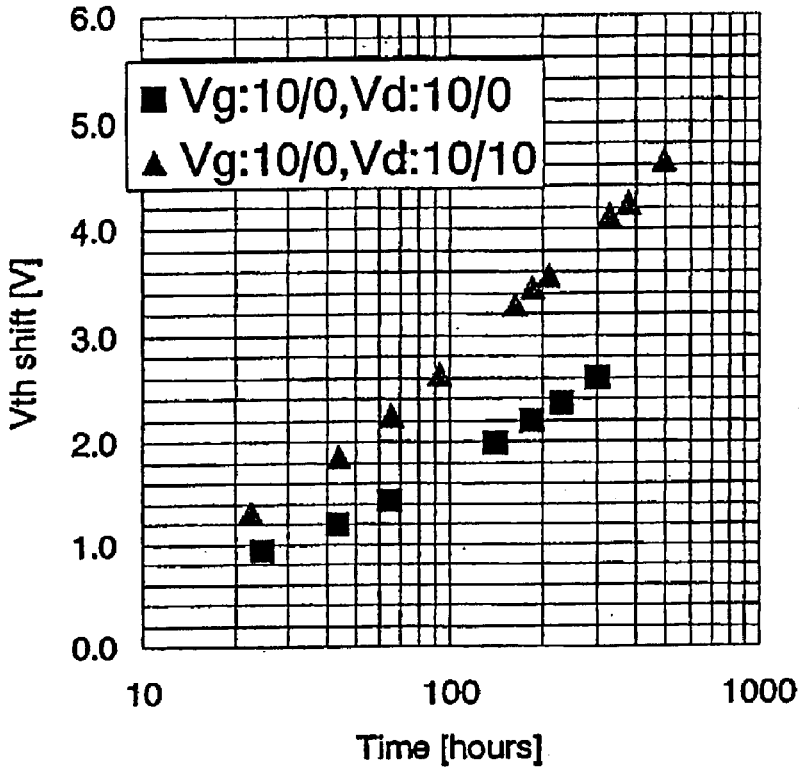
FIG. 4 is a graph showing variation of Vth over time of an amorphous silicon TFT at fifty degrees Celsius according to the prior art and according to the present invention.

FIG. 4 illustrates the variation of Vth over time of the driving TFT 22 at fifty degrees Celsius, according to the prior art (triangles) and according to the present invention (squares). The vertical axis indicates the variation in the threshold voltage (Vth) and the horizontal axis indicates the operating time in hours. In this example, the gate voltage and the drain voltage are changed at a duty cycle of 50%. In the prior art example, the drain voltage Vd is maintained at ten volts independent of the gate voltage which varies alternately—zero or ten volts (with some finite rise and fall rate). In the present invention, the drain voltage Vd is raised to ten volts when the gate voltage is raised to ten volts, and the drain voltage is dropped to zero volts when the gate voltage is dropped to zero volts. Thus, there is less "wear" on the drive TFT 22 because there is less often a voltage differential between the gate voltage (i.e. voltage between the gate and the source) and the drain voltage (i.e. voltage between the drain and the source). This extends the life of the driving TFT 22 to twice or longer than in the prior art where there are more often such voltage differential.

Figure 5:
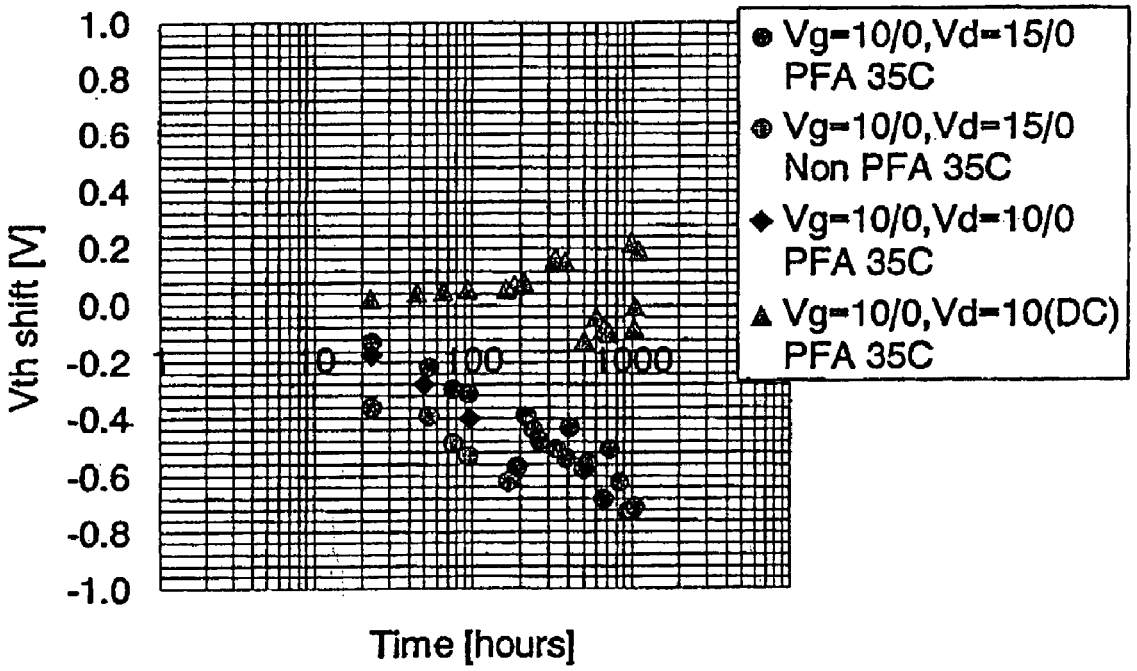
FIG. 5 is a graph showing variation of Vth over time of an amorphous silicon TFT at thirty five degrees Celsius when operated according to the prior art and according to the present invention.
Figure 6:
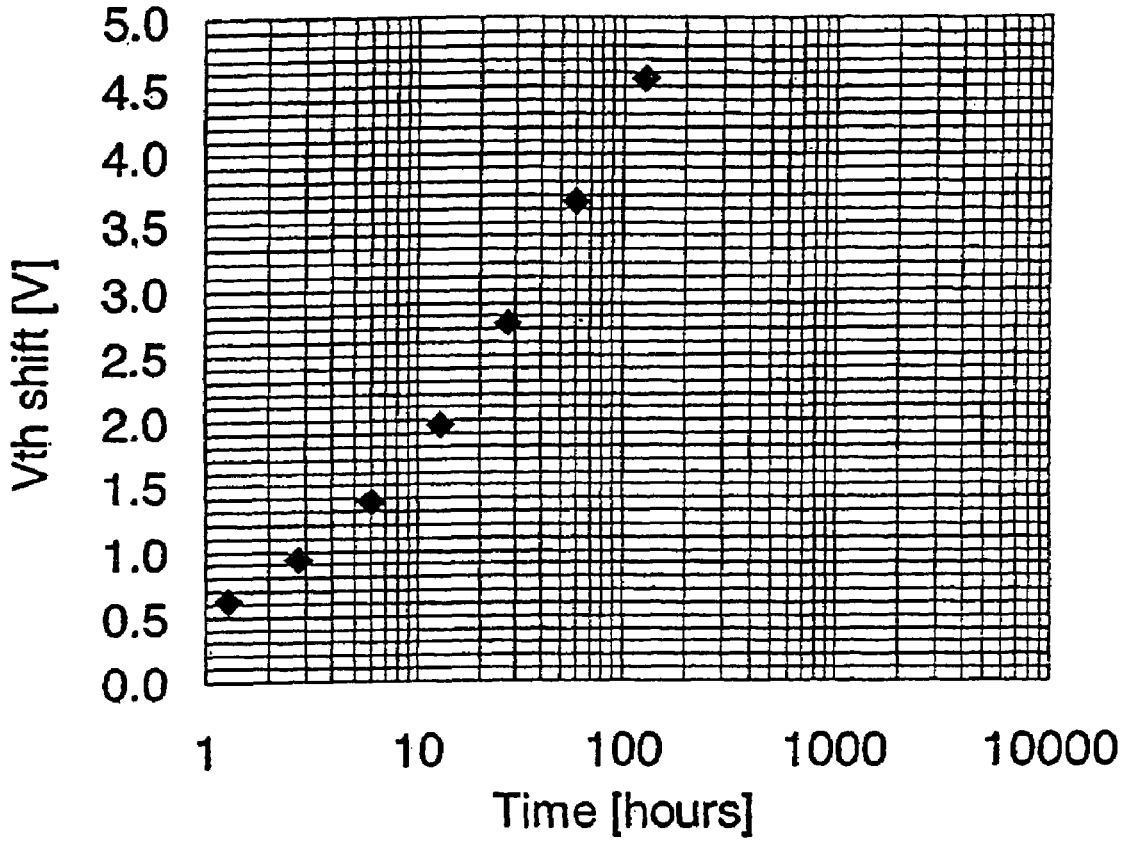
FIG. 6 (PRIOR ART)
FIG. 6 is a graph showing variation of Vth over time of an amorphous silicon TFT when operated according to the prior art.

FIG. 5 illustrates the variation of Vth over time of the driving TFT 22 at thirty five degrees Celsius, according to the prior art (triangles) and according to the present invention (gray/hashed circles, black circules and diamonds). The vertical axis indicates the variation in the threshold voltage (Vth) and the horizontal axis indicates the operating time in hours. In the illustrated example, the gate voltage and the drain voltage are changed at a duty cycle of 50%. In the prior art, the drain voltage Vd is maintained at ten volts independent of the gate voltage which varies alternately—zero or ten volts. In one example of the present invention indicated by the gray/hashed circles, the drain voltage Vd is raised to fifteen volts when the gate voltage is raised to ten volts and the drain voltage is dropped to zero volts when the gate voltage is dropped to zero volts. In another example of the present invention indicated by the black circles, the drain voltage Vd is raised to fifteen volts when the gate voltage is raised to ten volts and the drain voltage is dropped to zero volts when the gate voltage is dropped to zero volts. In a third example of the present invention indicated by the diamonds, the drain voltage Vd is raised to ten volts when the gate voltage is raised to ten volts and the drain voltage is dropped to zero volts when the gate voltage is dropped to zero volts, this in a PFA mode. As shown in FIG. 5, the tracking of the drain voltage to the gate voltage increases the useful life and operating characteristics of driving TFT 22.

During normal operation of drive circuits 20, 20 to generate an actual image, varying voltage levels are applied to the drains of driving TFTs 22 to cause varying current levels to be supplied to the OLEDs. A value of the supply-line voltage is based on an entire charge amount to be supplied to the TFT. This will yield the appropriate grey scale level for each pixel. However, when the driving TFT is shut off, the voltage of the drain of the driving TFT is likewise reduced to approximately zero volts.

The decrease in rise of Vth may be due to trapping of positive electric charges, or discharge of negative electric charges which originally exist therein. In the examples of FIG. 5, it is more likely the trapping of positive electric charges. In this scenario, an electron out of a pair of the electron and positive holes is initially excited by heat and escapes from the drain electrode and/or the source electrode by crossing over an $n^+$ barrier even when the voltage is dropped. On the contrary, the drain voltage is applied to the positive holes, which cannot cross over the $n^+$ barrier, in the prior art even when the voltage is stopped. Because there is a potential difference between the drain and the source, the positive holes disappear by forming a pair with electrons excited in the vicinity of the source. In the present invention, the potential difference between the drain and the source is eliminated by means of dropping the drain voltage when the gate voltage is dropped. Because the electrons are not excited, it is possible that the positive holes are trapped in the amorphous silicon and cause the decrease in rise of the threshold voltage (Vth). Although positive holes (positive electric charges) are trapped in the amorphous silicon TFT at an initial state, the positive holes are gradually trapped therein with passage of time by the above-described mechanism. This has a cancelling effect. Eventually, the increase of Vth can be reduced. Therefore, in order to cancel part of the positive shift with the effect of the negative shift and thereby reduce the rise in the threshold voltage (Vth), it is not necessary to raise the drain voltage simultaneously with the gate voltage. Instead, it is satisfactory if the voltage is supplied to the drain when the gate voltage is supplied to the gate electrode. In order to eliminate the potential difference between the drain and the source when the gate voltage is dropped, it is preferable that the supply of the voltage to the drain is dropped to zero when the gate voltage is dropped to zero. Moreover, a current value and the duty cycle for intermittently raising the voltage to be supplied to the drain are determined such that the total charge amount coincide as a result.

Although the present invention has been described above with the amorphous silicon TFT as the driving transistor, advantages can also be achieved according to the present invention with a polysilicon TFT as the driving transistor. However, there is less of an advantage because generally, poly silicon TFTs have a smaller increase in Vth over time.

Although the preferred embodiment of the present invention has been described in detail, it should be understood that various changes, substitutions and alternations can be made therein without departing from spirit and scope of the inventions as defined by the appended claims. For example, for opposite channel driving TFTs, the supply voltage is applied to the source and the gate voltage is changed accordingly.

The invention claimed is:

1. A display device comprising: an organic light-emitting diode (OLED); a thin-film transistor (TFT) coupled to drive said OLED; and a supply-line driver configured to substantially reduce a voltage differential between a drain and a source of said TFT synchronously when a control voltage applied to a gate of said TFT deactivates said TFT.

2. The display device according to claim 1, wherein the supply-line driver raises a supply-line voltage to provide an operational voltage differential between the drain and the source of said TFT synchronously when the control voltage of said gate activates said TFT.

3. The display device according to claim 1, wherein the supply-line driver lowers the voltage differential between said drain and said source to approximately zero volts when the gate voltage is approximately zero volts to deactivate said TFT.

4. The display device according to claim 1, wherein the supply-line driver raises the voltage differential between said drain and said source to approximately the control voltage for activating the gate of the TFT when the gate of the TFT is activated.

5. The display device according to claim 1, wherein the supply-line driver raises the voltage differential between said drain and said source to greater than the control voltage for activating the gate of the TFT when the gate of the TFT is activated.

6. The display device according to claim 1 further comprising a capacitor between a drain and gate of said TFT or between a source and gate of said TFT.

7. A display device comprising: an organic light-emitting diode (OLED); a transistor coupled to drive the OLED; and a supply-line driver coupled to supply a voltage to either a source or a drain of said transistor when a control voltage activates said transistor and reducing the voltage to the source or drain of said transistor synchronously when the control voltage deactives the transistor.

8. The display device according to claim 7, wherein the supply-line driver raises the supply-line voltage applied to either the source or the drain intermittently concurrently with application of the control voltage for activating the transistor.

9. The display device according to claim 7 further comprising a gate voltage supplying means for raising the gate voltage intermittently based on a scan-line signal supplied from a scan-line driver and a data-line signal supplied from a data-line driver, and wherein the supply-line driver reduces a supply-line voltage applied to either the source or the drain of the transistor synchronously with a drop of the gate voltage by the gate voltage supplying means.

10. The display device according to claim 7 further comprising a capacitor between a drain and gate of said transistor or between a source and gate of said transistor.

11. A method for controlling a thin-film transistor (TFT) which drives an organic light-emitting diode (OLED), said method comprising the steps of: applying a first supply voltage to either a source or a drain of the TFT when a first control voltage is applied to a gate of said TFT to activate said TFT and drive said OLED; and synchronously applying a second, lower supply voltage to said source or said drain of said TFT when a second control voltage is applied to said gate of said TFT to deactivate said TFT and turn off said OLED, whereby a voltage differential between said drain and said source when said second control voltage is applied to said gate is substantially lower than said first supply voltage.

12. The method of claim 11, wherein said first supply voltage is applied to said drain or said source substantially simultaneous with the application of said first control voltage to said gate, and said second supply voltage is applied to said drain or said source substantially simultaneous with the application of said second control voltage to said gate.

13. The method of claim 11 wherein said first and second supply voltage and said first and second control voltage are applied according to a predetermined duty cycle.

14. The method of claim 11 wherein said voltage differential between said drain and said source when said second control voltage is applied to said gate is approximately zero volts.

15. The display device of claim 1, wherein said TFT is coupled to the OLED via either the source or the drain of said TFT, and wherein the supply-line driver provides a variable supply voltage to the source or the drain of said TFT which is not coupled to the OLED to reduce the voltage differential.

16. The display device of claim 1, wherein said TFT does not have a constant supply voltage input to either the source or the drain.

17. The display device of claim 7, wherein said transistor is coupled to the OLED via either the source or the drain of said transistor, and wherein the supply-line driver provides a variable supply voltage to the source or the drain of said transistor which is not coupled to the OLED.

18. The display device of claim 7, wherein said transistor does not have a constant supply voltage input to either the source or the drain.

19. The display device of claim 18, wherein the variable supply voltage reduces a voltage potential across the source and the drain when the control voltage deactivates said transistor to deactivate of the OLED.

20. The method of claim 11, wherein said TFT is coupled to the OLED via either the source or the drain of said TFT, and wherein the supply-line driver provides the first supply voltage and the second supply voltage to the source or the drain of said TFT which is not coupled to the OLED to reduce the voltage differential.

21. The display device of claim 7, wherein the voltage to the source or drain is synchronously reduced at some time interval in reference to deactivating the transistor.

* * * * *